US009359709B2

(12) United States Patent
Prajescu et al.

(10) Patent No.: US 9,359,709 B2
(45) Date of Patent: Jun. 7, 2016

(54) DRYER APPLIANCE WITH FEATURES FOR LIMITING AIR LEAKAGES

(71) Applicant: General Electric Company, Schenectady, NY (US)

(72) Inventors: Ionelia Silvia Prajescu, Louisville, KY (US); Richard Dustin Henderson, Louisville, KY (US); Phillip John Duckworth, Louisville, KY (US)

(73) Assignee: General Electric Company, Schenectady, NY (US)

( * ) Notice: Subject to any disclaimer, the term of this patent is extended or adjusted under 35 U.S.C. 154(b) by 498 days.

(21) Appl. No.: 13/787,163

(22) Filed: Mar. 6, 2013

(65) Prior Publication Data

US 2014/0250719 A1 Sep. 11, 2014

(51) Int. Cl.

| | |
|---|---|
| ***F26B 11/02*** | (2006.01) |
| ***F26B 5/04*** | (2006.01) |
| ***F26B 25/00*** | (2006.01) |
| ***D06F 58/04*** | (2006.01) |
| *D06F 58/26* | (2006.01) |

(52) U.S. Cl.

CPC ..... *D06F 58/04* (2013.01); *D06F 58/26* (2013.01)

(58) Field of Classification Search

CPC ..... D06F 58/06; F26B 25/008
USPC ..... 34/601, 417, 242
See application file for complete search history.

(56) References Cited

U.S. PATENT DOCUMENTS

| | | | | |
|---|---|---|---|---|
| 4,899,464 | A * | 2/1990 | Carr et al. | 34/604 |
| 5,483,753 | A * | 1/1996 | Boivin | F26B 11/024 34/242 |
| 6,941,678 | B2 * | 9/2005 | Park | D06F 58/28 34/528 |
| 8,516,716 | B2 * | 8/2013 | Dal Ben et al. | 34/601 |
| 2005/0132603 | A1 * | 6/2005 | Jeong et al. | 34/603 |
| 2007/0151119 | A1 * | 7/2007 | Heyder et al. | 34/601 |

* cited by examiner

*Primary Examiner* — Kenneth Rinehart
*Assistant Examiner* — John McCormack
(74) *Attorney, Agent, or Firm* — Dority & Manning, P.A.

(57) ABSTRACT

A dryer appliance is provided. The dryer appliance includes a cabinet and a drum mounted therein. The dryer appliance also includes a heating assembly. A duct extends between the heating assembly and an opening defined by a back wall of the drum. A seal is positioned at the opening of the back wall and extends between the duct and the back wall of the drum.

16 Claims, 5 Drawing Sheets

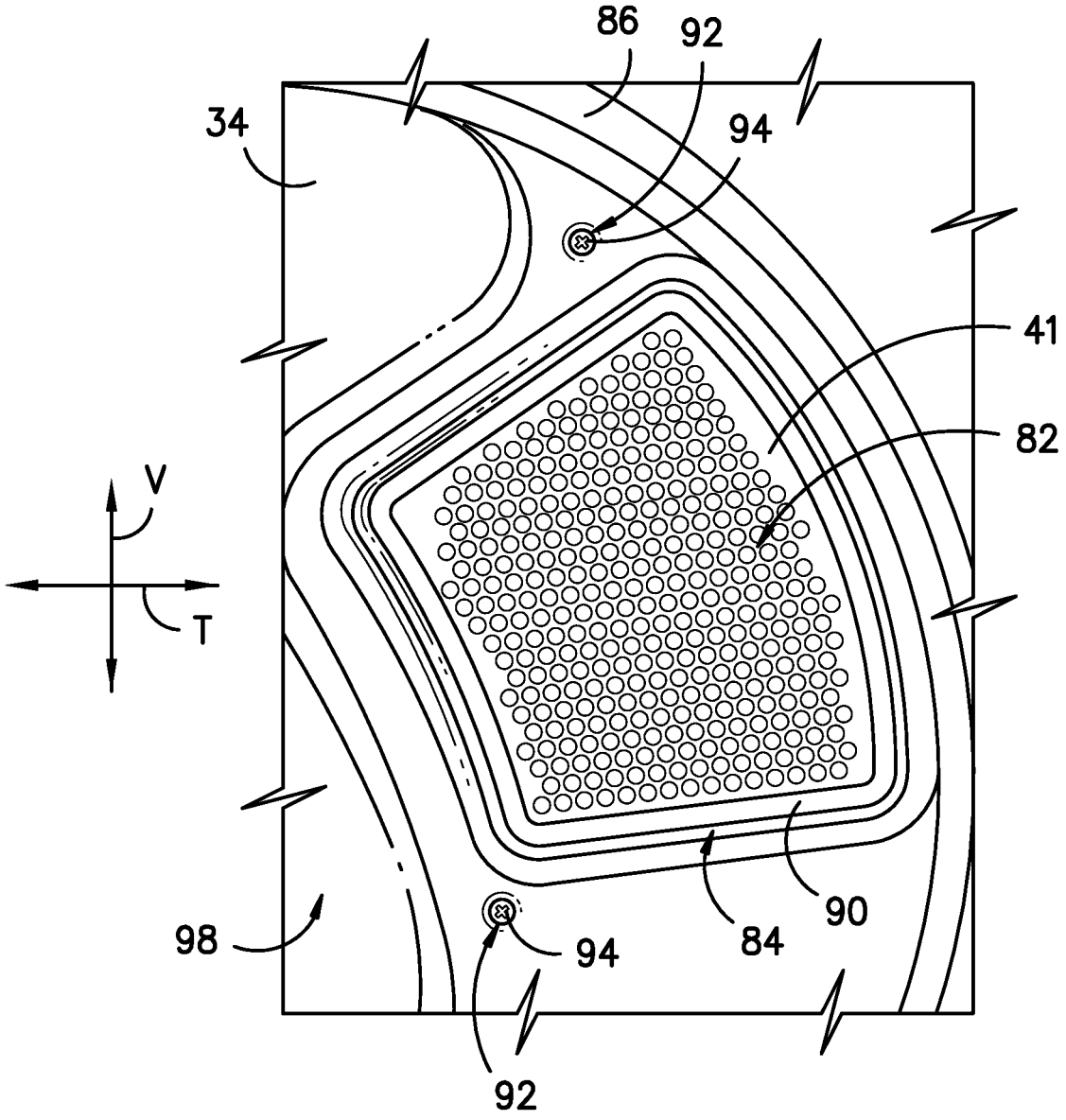
FIG. –5–

DRYER APPLIANCE WITH FEATURES FOR LIMITING AIR LEAKAGES

FIELD OF THE INVENTION

The present subject matter relates generally to dryer appliances, such as dryer appliances with fixed rear drum walls.

BACKGROUND OF THE INVENTION

Certain dryer appliances include a cabinet with a drum rotatably mounted therein. A heating assembly, such as an electric resistance heating element or a gas burner, can supply heated air to a chamber of the drum. For example, certain dryer appliances include a duct mounted to a back wall of the drum. The duct can direct heated air from the heating assembly into the chamber of the drum during operation of the dryer appliance. The duct generally includes an inlet that receives heated air from the heating assembly and a plurality of outlets for directing such heated air into the chamber of the drum. In particular, the back wall of the drum can define an opening, and outlets of the duct can be positioned such that heated air from the duct enters the chamber through the back wall's opening. Such heated air can assist with drying articles located within the drum's chamber.

In certain dryer appliances, the back wall of the drum is fixed or stationary. In such dryer appliances, the duct is generally mounted or secured to the back wall with fasteners that extend through the duct and into the back wall at an outer flange of the back wall that is spaced apart from the back wall's opening. Thus, the fasteners are remotely positioned relative to the back wall's opening. Due to the fasteners position, gaps between the duct and the back wall can arise, and such gaps can permit air leakage into the drum's chamber. Such air leakage can negatively affect performance of the dryer appliance. In particular, such air leakage can result in increased temperature of heated air exiting the duct's outlets.

Heated air exiting the duct's outlets is preferably maintained below a certain threshold temperature, e.g., to avoid damaging articles that are drying within the chamber of the drum and other overheating problems. Certain dryer appliances are equipped with temperature sensors for monitoring the temperature of heated air entering the drum's chamber. If the temperature sensor detects overly hot air entering the drum's chamber, the heating assembly can be deactivated or cycled. Such cycling can negatively affect performance of the dryer appliance by increasing drying times. Thus, air leakages into the drum's chamber through gaps between the duct and the back wall can negatively affect dryer performance.

Accordingly, a dryer appliance with features for improving performance of a dryer appliance would be useful. In particular, a dryer appliance with features for hindering or limiting air leakages through gaps between a duct of the dryer appliance and a back wall of a drum of the dryer appliance would be useful.

BRIEF DESCRIPTION OF THE INVENTION

The present subject matter provides a dryer appliance. The dryer appliance includes a cabinet and a drum mounted therein. The dryer appliance also includes a heating assembly. A duct extends between the heating assembly and an opening defined by a back wall of the drum. A seal is positioned at the opening of the back wall and extends between the duct and the back wall of the drum. Additional aspects and advantages of the invention will be set forth in part in the following description, or may be apparent from the description, or may be learned through practice of the invention.

In a first exemplary embodiment, a dryer appliance is provided. The dryer appliance includes a cabinet and a drum positioned within the cabinet. The drum defines a chamber for receipt of articles for drying. The drum has a back wall and a cylinder configured for rotation on the back wall of the drum. The back wall of the drum defines an opening. The dryer appliance also includes a heating assembly for generating heated air. A duct extends between an inlet and an outlet. The inlet of the duct is positioned at the heating assembly. The duct is mounted to the drum such that the outlet of the duct is positioned at the opening of the drum. A seal is positioned at the opening of the drum. The seal extends between the duct and the back wall of the drum.

In a second exemplary embodiment, a dryer appliance is provided. The dryer appliance includes a cabinet and a drum positioned within the cabinet. The drum defines a chamber for receipt of articles for drying. The drum has a back wall and a cylinder configured for rotation on the back wall of the drum. The back wall of the drum defines an opening. The dryer appliance also includes a heating assembly for generating heated air. A duct extends between the heating assembly and the opening of the drum. The duct and the back wall of the drum define a gap therebetween at the opening of the drum. At least one fastener mounts the duct to the back wall of the drum at the opening of the drum. A seal is positioned within the gap between the duct and the back wall of the drum. The seal extends between the duct and the back wall of the drum.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 5 provides a partial front, elevation view of the drum of FIG. 3.

DETAILED DESCRIPTION

Figure 1:
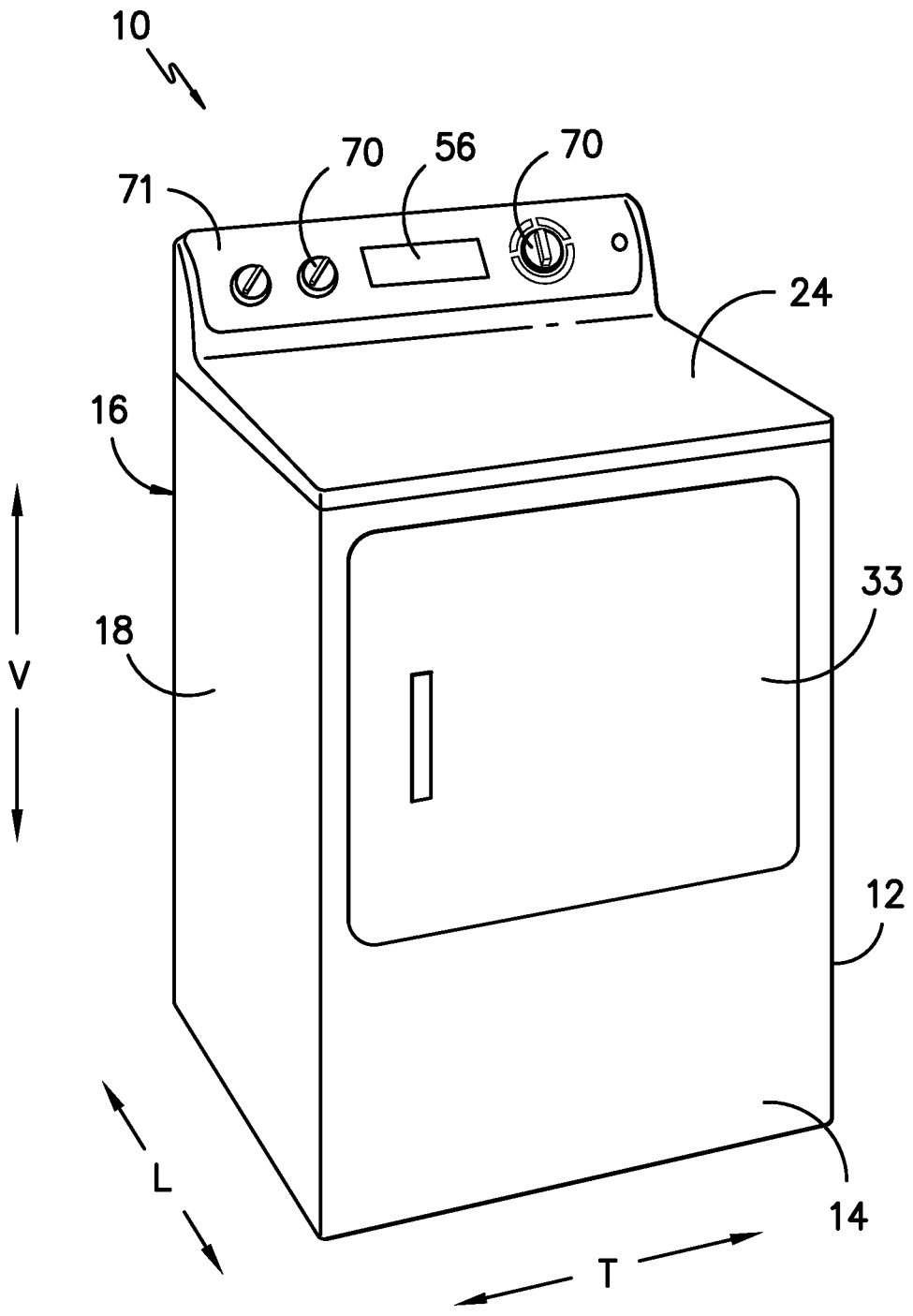
FIG. 1 provides a perspective view of a dryer appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
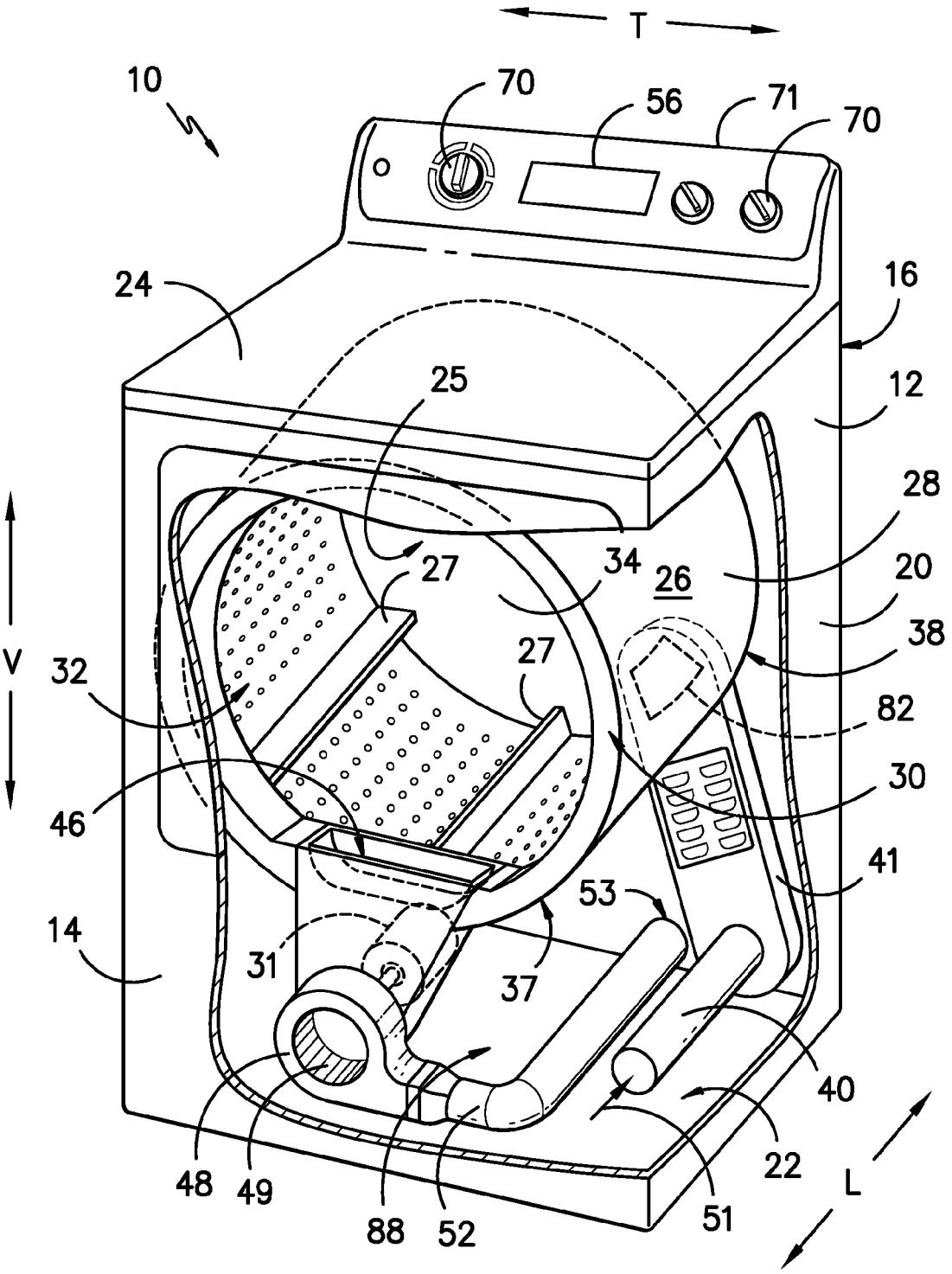
FIG. 2 provides a perspective view of the dryer appliance of FIG. 1 with portions of a cabinet of the dryer appliance removed to reveal certain components of the dryer appliance.

FIG. 1 illustrates a dryer appliance 10 according to an exemplary embodiment of the present subject matter. FIG. 2 provides another perspective view of dryer appliance 10 with a portion of a cabinet or housing 12 of dryer appliance 10 removed in order to show certain components of dryer appliance 10. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. Dryer appliance 10 defines a vertical direction V, a lateral direction L, and a transverse direction T. The vertical direction V, lateral direction L, and transverse direction T are mutually perpendicular and form and orthogonal direction system.

Cabinet 12 includes a front panel 14, a rear panel 16, a pair of side panels 18 and 20 spaced apart from each other by front and rear panels 14 and 16, a bottom panel 22, and a top cover 24. Within cabinet 12 is a drum or container 26 mounted for rotation about a substantially horizontal axis, e.g., that is parallel or substantially parallel to the lateral direction L. Drum 26 defines a chamber 25 for receipt of articles, e.g., clothing, linen, etc., for drying. Drum 26 extends between a front portion 37 and a back portion 38, e.g., along the lateral direction L.

A motor 31 is configured for rotating drum 26 about the horizontal axis, e.g., via a pulley and a belt (not shown). Drum 26 is generally cylindrical in shape, having an outer cylindrical wall or cylinder 28 and a front flange or wall 30 that defines an entry 32 of drum 26, e.g., at front portion 37 of drum 26, for loading and unloading of articles into and out of chamber 25 of drum 26. A plurality of tumbling ribs 27 are provided within chamber 25 of drum 26 to lift articles therein and then allow such articles to tumble back to a bottom of drum 26 as drum 26 rotates. Drum 26 also includes a back or rear wall 34, e.g., at back portion 38 of drum 26. Cylinder 28 is rotatable on rear wall 34 as will be understood by those skilled in the art. A duct 41 is mounted to rear wall 34 and receives heated air that has been heated by a heating assembly or system 40.

Motor 31 is also in mechanical communication with an air handler 48 such that motor 31 rotates a fan 49, e.g., a centrifugal fan, of air handler 48. Air handler 48 is configured for drawing air through chamber 25 of drum 26, e.g., in order to dry articles located therein as discussed in greater detail below. In alternative exemplary embodiments, dryer appliance 10 may include an additional motor (not shown) for rotating fan 49 of air handler 48 independently of drum 26.

Drum 26 is configured to receive heated air that has been heated by a heating assembly 40, e.g., in order to dry damp articles disposed within chamber 25 of drum 26. Heating assembly 40 includes a heating element (not shown), such as a gas burner or an electrical resistance heating element, for heating air. As discussed above, during operation of dryer appliance 10, motor 31 rotates drum 26 and fan 49 of air handler 48 such that air handler 48 draws air through chamber 25 of drum 26 when motor 31 rotates fan 49. In particular, ambient air enters heating assembly 40 via an entrance 51 due to air handler 48 urging such ambient air into entrance 51. Such ambient air is heated within heating assembly 40 and exits heating assembly 40 as heated air. Air handler 48 draws such heated air through duct 41 to drum 26. The heated air enters drum 26 through an outlet 82 of duct 41 positioned at rear wall 34 of drum 26.

Within chamber 25, the heated air can accumulate moisture, e.g., from damp articles disposed within chamber 25. In turn, air handler 48 draws moisture statured air through a screen filter (not shown) which traps lint particles. Such moisture statured air then enters an exit conduit 46 and is passed through air handler 48 to an exhaust conduit 52. From exhaust conduit 52, such moisture statured air passes out of dryer appliance 10 through a vent 53 defined by cabinet 12. After the clothing articles have been dried, they are removed from the drum 26 via entry 32. A door 33 provides for closing or accessing drum 26 through entry 32.

A cycle selector knob 70 is mounted on a cabinet backsplash 71 and is in communication with a processing device or controller 56. Signals generated in controller 56 operate motor 31 and heating assembly 40 in response to the position of selector knobs 70. Alternatively, a touch screen type interface may be provided. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements such as e.g., electrically erasable, programmable read only memory (EEPROM).

As discussed in greater detail below, dryer appliance 10 also includes features for mounting duct 41 to rear wall 34 of drum 26. In particular, dryer appliance 10 includes features for securing duct 41 to rear wall 34 in order to limit or hinder air leakage at an opening 84 (FIG. 4) defined by rear wall 34 of drum 26 where heated air from duct 41 enters chamber 25 of drum 26 via outlet 82 of duct 41. For example, cabinet 12 defines an interior volume 88. Drum 26 is positioned within interior volume 88 of cabinet 12, and dryer appliance 10 includes features for obstructing fluid flow, e.g., a flow of air, between interior volume 88 of cabinet 12 and chamber 25 of drum 26 through opening 84 of drum 26.

Figure 3:
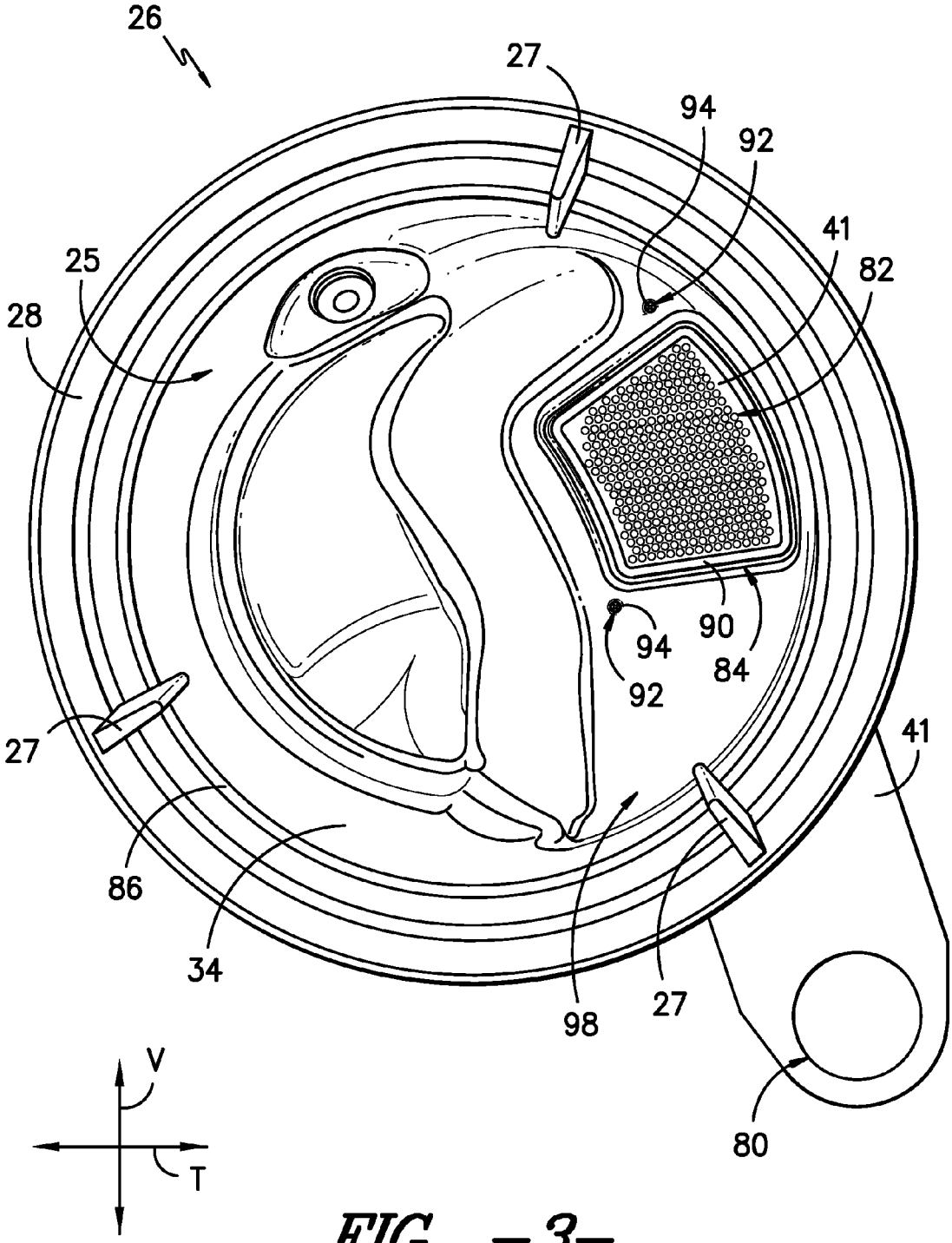
FIG. 3 provides a front, perspective view of a drum of the dryer appliance of FIG. 1.
Figure 4:
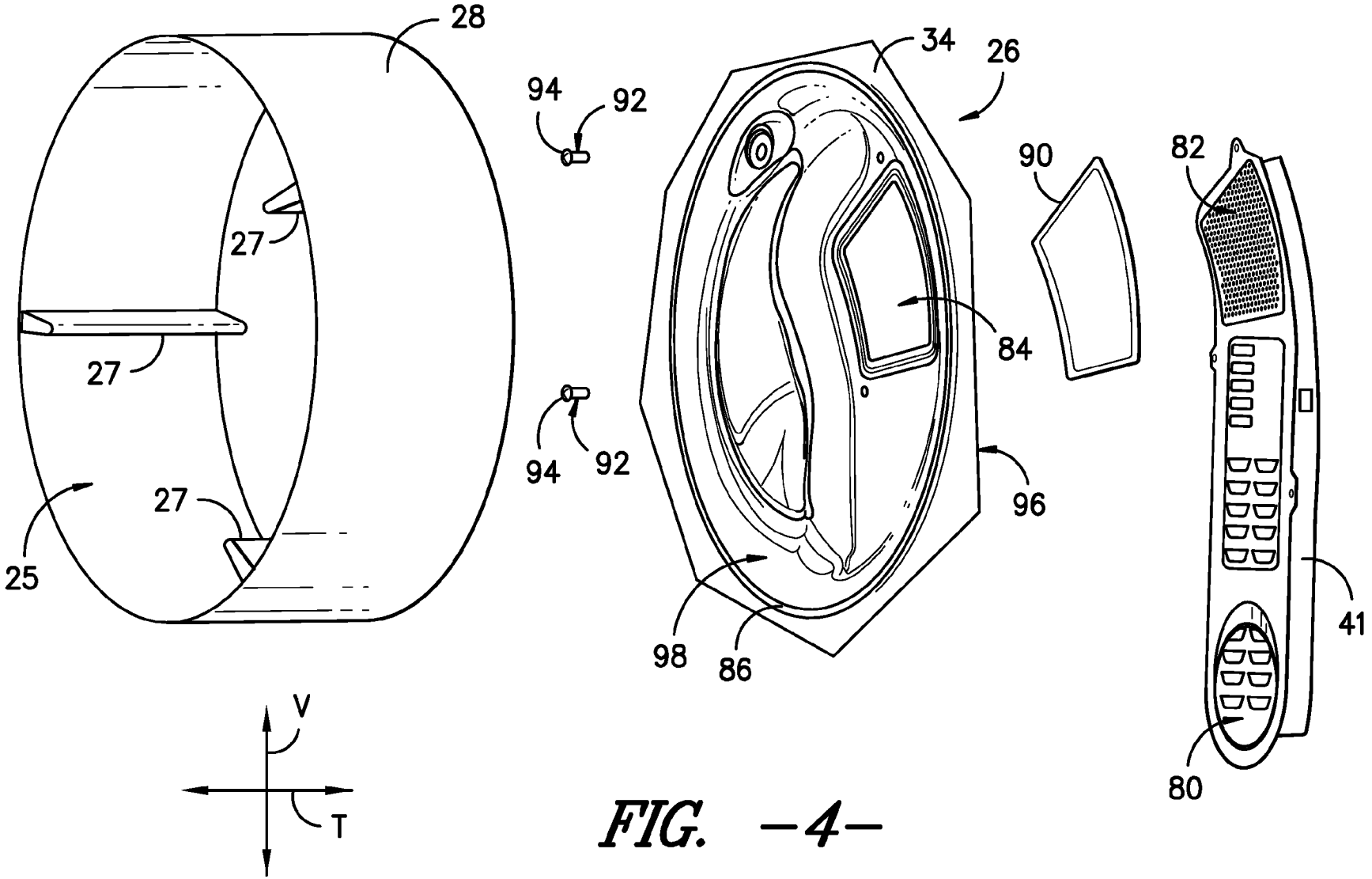
FIG. 4 provides an exploded view of the drum of FIG. 3.

FIG. 3 provides a front, perspective view of drum 26 of dryer appliance 10. FIG. 4 provides an exploded view of drum 26. As may be seen in FIGS. 3 and 4, drum 26 includes rear wall 34 and cylinder 28. Cylinder 28 is configured for rotation on rear wall 34 of drum 26. In particular, rear wall 34 defines a rotation support ring 86. Cylinder 28 is rotatably mounted on rear wall 34 such that cylinder 28 rides on rotation support ring 86 during rotation of cylinder 28 with motor 31 (FIG. 2). In particular, rotation support ring 86 has a slightly smaller diameter than cylinder 28 such that cylinder 28 mounts over rotation support ring 86 and an inner surface of cylinder 28 rides on rotation support ring 86 during rotation of cylinder 28.

As discussed above, rear wall 34 of drum 26 defines opening 84. Duct 41 extends between heating assembly 40 (FIG. 2) and opening 84 of drum 26. In particular, duct 41 extends between an inlet 80 and an outlet 82. Inlet 80 of duct 41 is positioned at heating assembly 40 and is configured for receipt of heated air therefrom. Duct 41 directs such heated air therethrough to outlet 82 of duct 41. Outlet 82 of duct 41 is positioned at opening 84 of drum 26. In particular, duct 41 is mounted to rear wall 34 such that outlet 82 of duct 41 is positioned at opening 84 of drum 26.

When duct 41 is mounted to rear wall 34, duct 41 and rear wall 34 of drum 26 define a gap (not shown) therebetween, e.g., at opening 84 of drum 26. As will be understood by those skilled in the art, portions of duct 41 and rear wall 34 are spaced apart from each other at opening 84 of drum 26, e.g., along the lateral direction L, when duct 41 is mounted to rear wall 34. Such spacing generates the gap between duct 41 and rear wall 34. Dryer appliance 10 includes features for hindering or limiting fluid flow, e.g., air flow, through the gap into or out of chamber 25 of drum 26 other than heated air from duct 41.

FIG. 5 provides a partial front, elevation view of drum 26 and duct 41 mounted to drum 26 at opening 84 of rear wall 34. As may be seen in FIG. 5, a gasket or seal 90 is positioned at opening 84 of drum 26. In particular, seal 90 is positioned within the gap between duct 41 and rear wall 34 of drum 26. Seal 90 extends between duct 41 and rear wall 34 of drum 26 and fills the gap, e.g., in order to hinder or eliminate fluid flow between chamber 25 of drum 26 and interior volume 88 of cabinet 12 (FIG. 2) through the gap. Thus, seal 90 can assist with limiting or hindering fluid flow into chamber 25 of drum 26 through opening 84 of rear wall 34. Seal 90 can be constructed with any suitable material. For example, seal 90 may be constructed with silicone, ceramic fibers, etc. Seal 90 may be configured or conducted to withstand temperatures exceeding about four hundred degrees Fahrenheit.

Rear wall 34 of drum 26 includes a rear surface 96 (FIG. 4) and a front surface 98. Rear and front surfaces 96 and 98 are spaced apart from each other, e.g., along the lateral direction L. Thus, rear and front surfaces 96 and 98 are positioned opposite each other on rear wall 34. Front surface 98 of rear wall 34 faces chamber 25 of drum 26. Conversely, rear surface 96 of rear wall 34 faces duct 41 and, e.g., interior volume 88 of cabinet 12. Seal 90 is positioned on rear surface 96 of rear wall 34, e.g., between rear wall 34 and duct 41.

Seal 90 extends around opening 84 of rear wall 34. In particular, seal 90 extends around opening 84, e.g., in a plane that is perpendicular to the lateral direction L. Thus, seal 90 surrounds and encircles opening 84, and, in such a manner, seal 90 can assist with limiting or obstructing fluid flow into chamber 25 of drum 26 through opening 84 of rear wall 34, e.g., from interior volume 88 of cabinet 12.

At least one fastener 92 mounts duct 41 to rear wall 34 of drum 26, e.g., at opening 84 of drum 26. The at least one fastener 92 is positioned within rotation support ring 86 of drum 26 and extends between rear wall 34 of drum 26 and duct 41 in order to couple duct 41 to rear wall 34 of drum 26. In addition, the at least one fastener 92 is positioned proximate opening 84 of drum 26. As an example, each fastener of the at least one fastener 92 can be positioned within about one inch, two inches, or three inches of opening 84 of rear wall 34, e.g., along the transverse and vertical directions T and V. In such a manner, duct 41 can be mounted or secured to rear wall 34 at opening 84, and the at least one fastener 92 can assist with limiting or obstructing fluid flow into chamber 25 of drum 26 through opening 84 of rear wall 34 other than from duct 41. For example, the at least one fastener 92 can assist with bringing or urging duct 41 and rear wall 34 together, e.g., along the transverse direction T. In such a manner, the gap between duct 41 and rear wall 34 can be reduced and fluid flow through the gap can be limited or obstructed. In addition, the at least one fastener 92 can assist with hindering or limiting duct 41 from moving away from rear wall 34, e.g., along the transverse direction T, and hinder gasp from increasing in size. Thus, by coupling duct 41 and rear wall 34 together with the at least one fastener 92, a size of the gap can be controlled and regulated.

In the exemplary embodiment shown in FIG. 5, the at least one fastener 92 includes two fasteners that are positioned on opposite sides of opening 84 relative to each other. It should be understood that in alternative exemplary embodiments, dryer appliance 10 can include any suitable number of fasteners 92. For example, dryer appliance 10 may include one fastener, three fasteners, four fasteners, five fasteners, or more.

In the exemplary embodiment shown in FIG. 5, the at least one fastener 92 is shown as a screw that extends through rear wall 34 of drum 26 into duct 41. It should be understood that the at least one fastener 92 can be any suitable fastener in alternative exemplary embodiments. For example, the at least one fastener 92 may be a spot weld, a bolt, a rivet, etc., or combinations thereof. As may be seen in FIG. 5, a head 94 of the at least one fastener 92 is positioned within chamber 25 of drum 26.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet;

a drum positioned within said cabinet, said drum defining a chamber for receipt of articles for drying, said drum having a back wall and a cylinder configured for rotation on the back wall of said drum, the back wall of said drum defining an opening;

a heating assembly for generating heated air;

a duct extending between an inlet and an outlet, the inlet of said duct positioned at said heating assembly, said duct mounted to said drum such that the outlet of said duct is positioned at the opening of said drum;

a seal positioned at the opening of said drum in a gap between said duct and the back wall of said drum; and at least one fastener, having a fastener head positioned within the chamber of said drum, extending between the back wall of said drum and said duct in order to couple said duct to the back wall of said drum, said at least one fastener positioned proximate the opening of said drum and configured for controlling and regulating a size of the gap.

2. The dryer appliance of claim 1, wherein the back wall of said drum defines a rotation support ring on which the cylinder of said drum is rotatable, said at least one fastener positioned within the rotation support ring of said drum.

3. The dryer appliance of claim 1, wherein said at least one fastener comprises at least one screw.

4. The dryer appliance of claim 1, wherein said at least one fastener comprises two fasteners, the two fasteners positioned on opposite sides of the opening of said drum relative to each other.

5. The dryer appliance of claim 1, wherein said cabinet defines an interior volume, said drum positioned within the interior volume of said cabinet, said seal configured for obstructing fluid flow between the interior volume of said cabinet and the chamber of said drum through the opening of said drum.

6. The dryer appliance of claim 1, wherein the back wall of said drum includes a rear surface that faces said duct, said seal positioned on the rear surface of the back wall of said drum.

7. The dryer appliance of claim 6, wherein said seal extends around the opening of said drum.

8. A dryer appliance, comprising:

a cabinet;

a drum positioned within said cabinet, said drum defining a chamber for receipt of articles for drying, said drum having a back wall and a cylinder configured for rotation on the back wall of said drum, the back wall of said drum defining an opening;

a heating assembly for generating heated air;

a duct extending between said heating assembly and the opening of said drum, said duct and the back wall of said drum defining a gap therebetween at the opening of said drum;

at least one fastener mounting said duct to the back wall of said drum at the opening of said drum;

a seal positioned within the gap between said duct and the back wall of said drum, said seal extending between said duct and the back wall of said drum; and at least one fastener, having a fastener head positioned within the chamber of said drum, extending between the back wall of said drum and said duct in order to couple said duct to the back wall of said drum, said at least one fastener positioned proximate the opening of said drum and configured for controlling and regulating a size of the gap.

9. The dryer appliance of claim 8, wherein the back wall of said drum defines a rotation support ring on which the cylinder of said drum is rotatable, said at least one fastener positioned within the rotation support ring of said drum.

10. The dryer appliance of claim 8, wherein said at least one fastener comprises at least one screw.

11. The dryer appliance of claim 8, wherein said at least one fastener comprises two fasteners, the two fasteners positioned on opposite sides of the opening of said drum relative to each other.

12. The dryer appliance of claim 8, wherein said cabinet defines an interior volume, said drum positioned within the interior volume of said cabinet, said seal configured for obstructing fluid flow between the interior volume of said cabinet and the chamber of said drum through the opening of said drum.

13. The dryer appliance of claim 8, wherein the back wall of said drum includes a rear surface that faces said duct, said seal positioned on the rear surface of the back wall of said drum.

14. The dryer appliance of claim 13, wherein said seal extends around the opening of said drum.

15. The dryer appliance of claim 1, wherein said seal comprises at least one material selected from the group consisting of silicone and ceramic fibers.

16. The dryer appliance of claim 8, wherein said seal comprises at least one material selected from the group consisting of silicone and ceramic fibers.

* * * * *